US007722221B2

(12) United States Patent
Chae

(10) Patent No.: US 7,722,221 B2
(45) Date of Patent: May 25, 2010

(54) LIGHT EMITTING DIODE LIGHT SOURCE

(75) Inventor: Joon Seok Chae, Gyeonggi-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 209 days.

(21) Appl. No.: 12/000,303

(22) Filed: Dec. 11, 2007

(65) Prior Publication Data

US 2008/0212336 A1 Sep. 4, 2008

(30) Foreign Application Priority Data

Dec. 11, 2006 (KR) ..... 10-2006-0125602

(51) Int. Cl.
*F21V 29/00* (2006.01)

(52) U.S. Cl. ..... 362/294; 362/217.05

(58) Field of Classification Search ..... 362/217.21–217.17

See application file for complete search history.

(56) References Cited

U.S. PATENT DOCUMENTS

2003/0156416 A1* 8/2003 Stopa et al. ..... 362/294
2005/0265019 A1* 12/2005 Sommers et al. ..... 362/217
2006/0193131 A1* 8/2006 McGrath et al. ..... 362/227
2007/0211458 A1* 9/2007 Bertram et al. ..... 362/227
2008/0151535 A1* 6/2008 de Castris ..... 362/220
2009/0168395 A1* 7/2009 Mrakovich et al. ..... 362/84
2009/0219713 A1* 9/2009 Siemiet et al. ..... 362/218

FOREIGN PATENT DOCUMENTS

KR 10-2004-0021705 3/2004

* cited by examiner

*Primary Examiner*—David V Bruce
(74) *Attorney, Agent, or Firm*—McDermott Will & Emery LLP

(57) ABSTRACT

Provided is an LED light source including a frame having a V-shaped groove formed in the upper portion thereof and a heat sink formed to extend from the lower portion thereof, the V-shaped groove having a planar bottom surface on which a circuit pattern is formed; a plurality of LEDs disposed on the bottom surface of the V-shaped groove; a diffuser plate coupled to the upper end of the frame so as to diffuse light emitted from the plurality of LEDs; a pair of plugs coupled to both side ends of the frame and receiving alternating-current (AC) power from outside; and a power converter fixed and coupled to the lower portion of the frame and electrically connected to the plugs and the plurality of LEDs, the power converter converting the AC power applied from the plugs into direct-current (DC) power and supplying the DC power to the LEDs.

9 Claims, 4 Drawing Sheets

LIGHT EMITTING DIODE LIGHT SOURCE

CROSS-REFERENCE TO RELATED APPLICATIONS

This application claims the benefit of Korean Patent Application No. 10-2006-0125602 filed with the Korea Intellectual Property Office on Dec. 11, 2006, the disclosure of which is incorporated herein by reference.

BACKGROUND OF THE INVENTION

1. Field of the Invention

The present invention relates to a light emitting diode (LED) light source.

2. Description of the Related Art

In general, light sources are referred to as heavenly bodies, such as the sun which emit lights for itself and the moon which emits light by reflecting the solar light, and light emitting devices such as electric lamps, neon signs, and LEDs which are manufactured to emit light.

Among the light sources, the LEDs are frequently used as display lamps and light sources of vehicles or home electronic appliances for a daily life. In the early stage, most of LEDs have been manufactured as low-luminance products. With the development of raw materials of LEDs and manufacturing technology, high-luminance LEDs are being manufactured so as to emit light which can represent all colors including white within the visible-light region. The high-luminance LEDs are applied to large-sized LED electric signs, exit lamps, traffic lights, various display lights of vehicles, which emit various colors of light with high luminance and high efficiency.

Hereinafter, a conventional light source will be described with reference to accompanying drawings.

FIG. 1 is a perspective view of a conventional light source.

As shown in FIG. 1 the conventional light source includes a pair of plugs 10, a plurality of terminals 20, a pair of LEDs 30, and a transparent rod 40.

Each of the plug 10 has two terminals 20 formed to project from one end thereof and is coupled to an end of the transparent rod 40. Further, the plug 10 includes a circuit board (not shown) having a plurality of electronic components mounted therein and supplies direct-current (DC) power, supplied through the terminals 20, to the LED 30.

The terminals 20 are connected to the outside so as to receive DC power.

The LED 30 is coupled to the plug 10 and is mounted in the transparent rod 40. The LED 30 receives DC power supplied through the terminals 20 so as to emit light.

Both ends of the transparent rod 40 are coupled to the plugs 10, and the LEDs 30 connected to the plugs 10 are mounted in the transparent rod 40. The transparent rod 40 is formed of a circular or rectangular transparent injection-molded rod member, and the surface thereof is surface-treated with a spreading agent or dispersing agent.

When DC power is supplied through the terminals 20 of each plug 10, the LEDs 30 receive the DC power so as to emit light to the outside through the transparent rod 40. In this way, the conventional light source can be used as illumination.

In the conventional light source, however, the light emitted from the LEDs 30 is indirectly projected through the transparent rod 40. Therefore, an intensity of illumination required for a daily life cannot be secured. Further, as most of electric energy supplied to the LED 30 is converted into thermal energy so as to be lost, light efficiency is reduced, and surrounding equipments are deteriorated.

Further, the conventional light source should be additionally provided with a separate power converter for converting AC power into DC power, in order to receive DC power supplied to the LED 30.

SUMMARY OF THE INVENTION

An advantage of the present invention is that it provides an LED light source which has a power converter provided therein, directly receives AC power from outside to convert into DC power, and then supplies the DC power to LEDs, thereby enhancing efficiency. Further, the LED light source has a heat sink integrally formed therein, thereby enhancing thermal efficiency.

Additional aspects and advantages of the present general inventive concept will be set forth in part in the description which follows and, in part, will be obvious from the description, or may be learned by practice of the general inventive concept.

According to an aspect of the invention, an LED light source comprises a frame having a V-shaped groove formed in the upper portion thereof and a heat sink formed to extend from the lower portion thereof, the V-shaped groove having a planar bottom surface on which a circuit pattern is formed; a plurality of LEDs disposed on the bottom surface of the V-shaped groove; a diffuser plate coupled to the upper end of the frame so as to diffuse light emitted from the plurality of LEDs; a pair of plugs coupled to both side ends of the frame and receiving alternating-current (AC) power from outside; and a power converter fixed and coupled to the lower portion of the frame and electrically connected to the plugs and the plurality of LEDs, the power converter converting the AC power applied from the plugs into direct-current (DC) power and supplying the DC power to the LEDs.

Preferably, the V-shaped groove of the frame has both side walls formed of reflecting surfaces, and the V-shaped groove of the frame has both side walls formed of inclined surfaces between which the width decreases toward the lower portion.

Preferably, the heat sink is not formed on the lower portion of the frame to which the power converter is coupled, the frame is formed integrally with or separately from the heat sink, and the heat sink of the frame has a plurality of heat sink pieces formed at even intervals.

Preferably, the diffuser plate is any one selected from a transparent plate or a fluorescent plate containing a fluorescent material, and the LEDs are one or more LED selected from a white LED, a blue LED, an ultraviolet (UV) LED, an RGB LED, and a single-color LED.

When the LED is the white LED, a transparent plate is used as the diffuser plate. When the LED is the blue LED or the UV LED, a fluorescent plate is used as the diffuser plate. When the LED is the RGB LED or the single-color LED, a transparent plate is used as the diffuser plate.

Preferably, the LEDs are simultaneously driven. When the LED is the RGB LED, R, G, and B LEDs of the RGB LED are separately driven.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
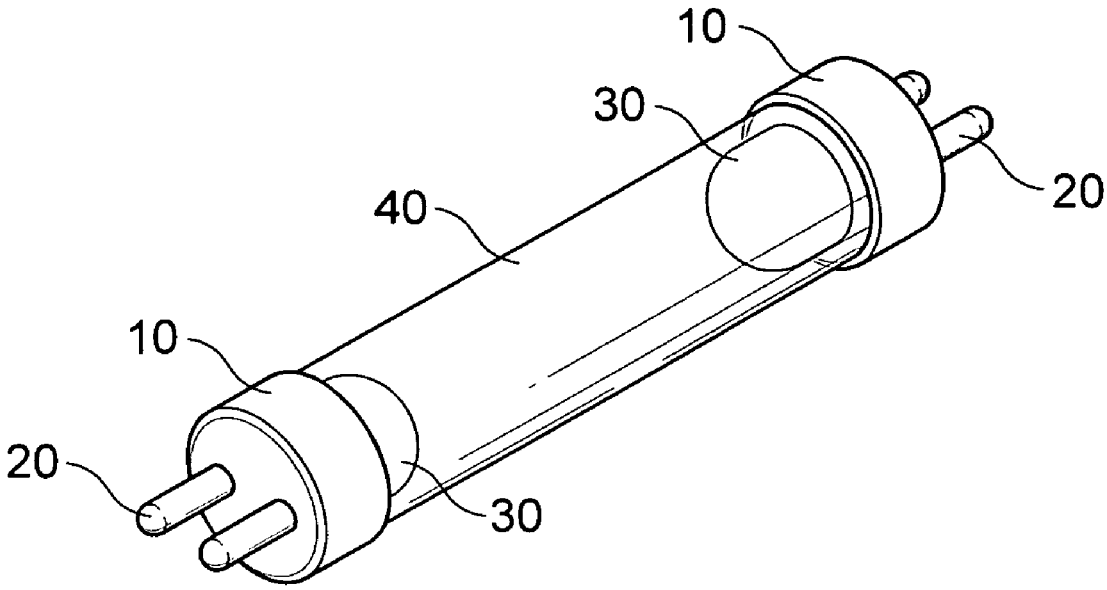
FIG. 1 is a perspective view of a conventional light source.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Hereinafter, an LED light source according to the present invention will be described in detail with reference to the accompanying drawings.

Figure 2:
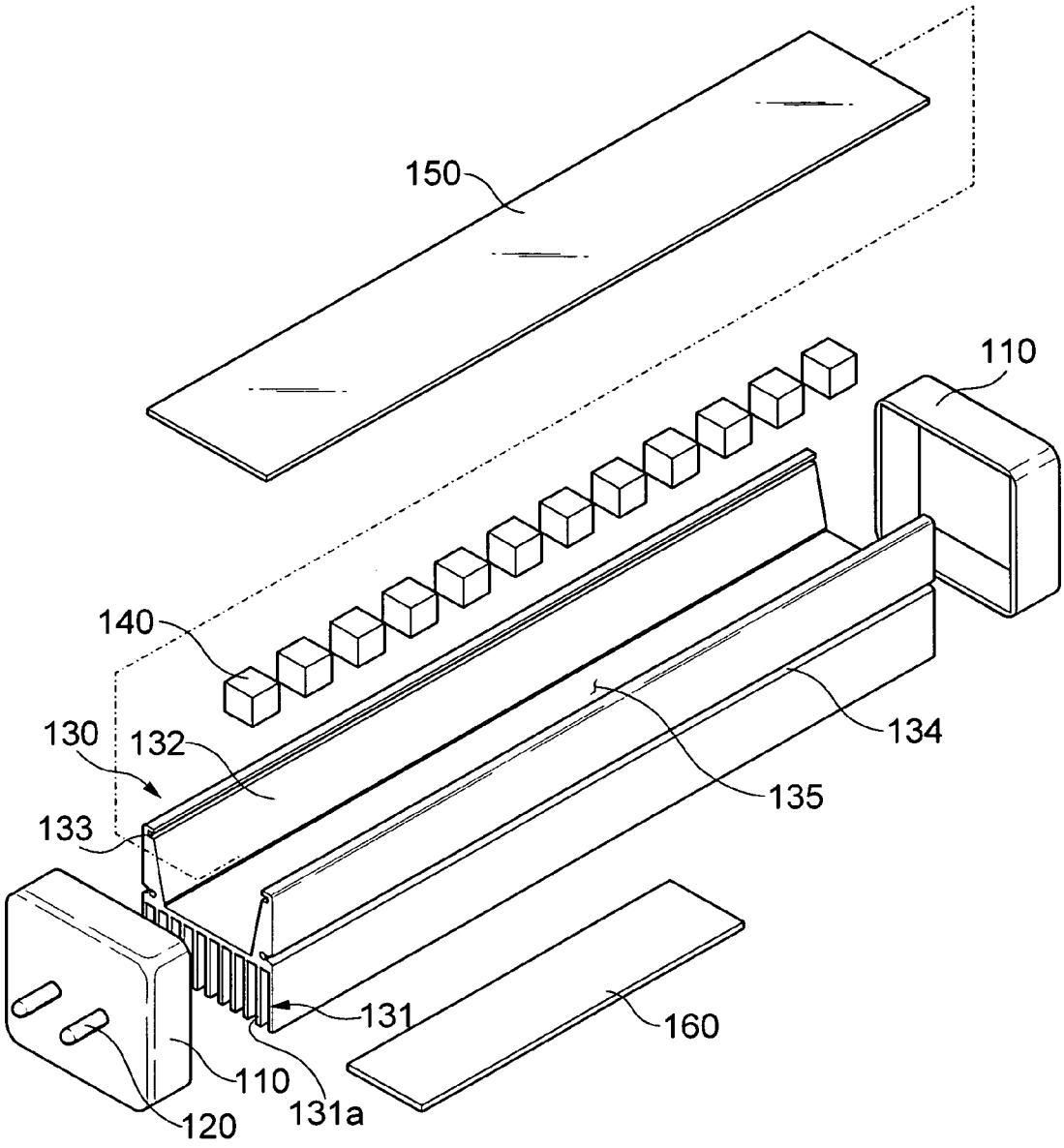
FIG. 2 is an exploded perspective view of an LED light source according to the invention.
Figure 3:
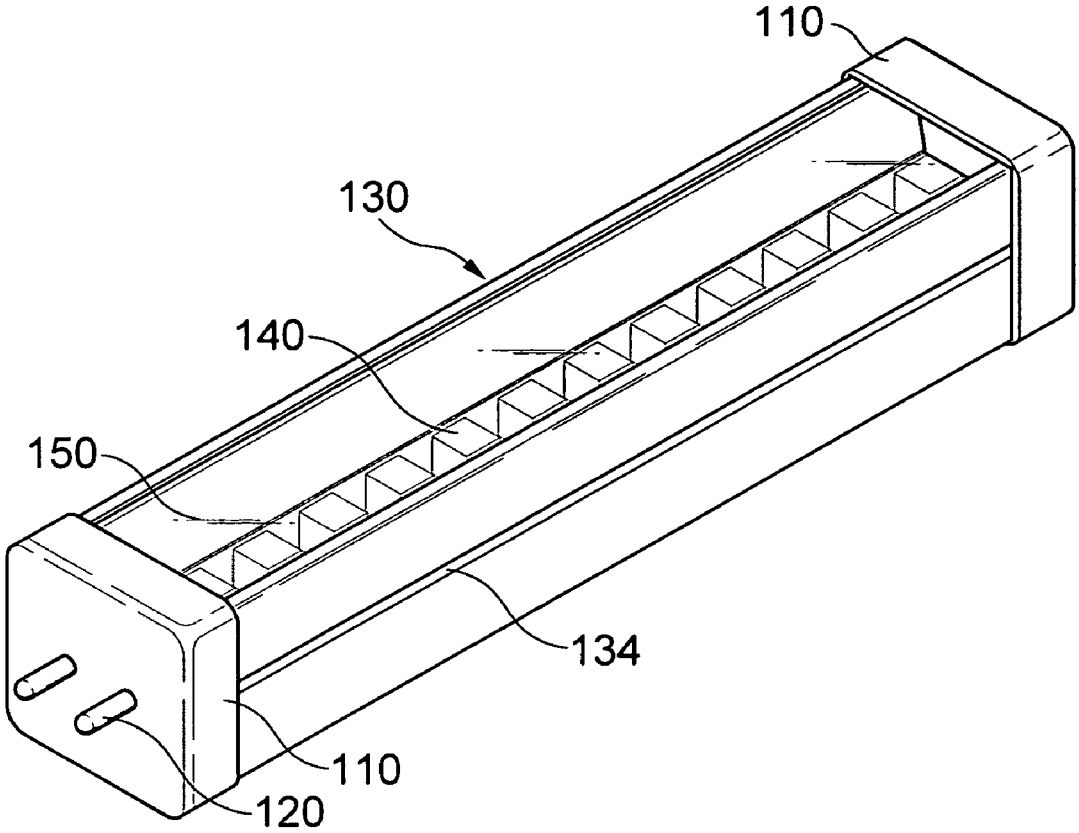
FIG. 3 is an assembled perspective view of the LED light source according to the invention.
Figure 4:
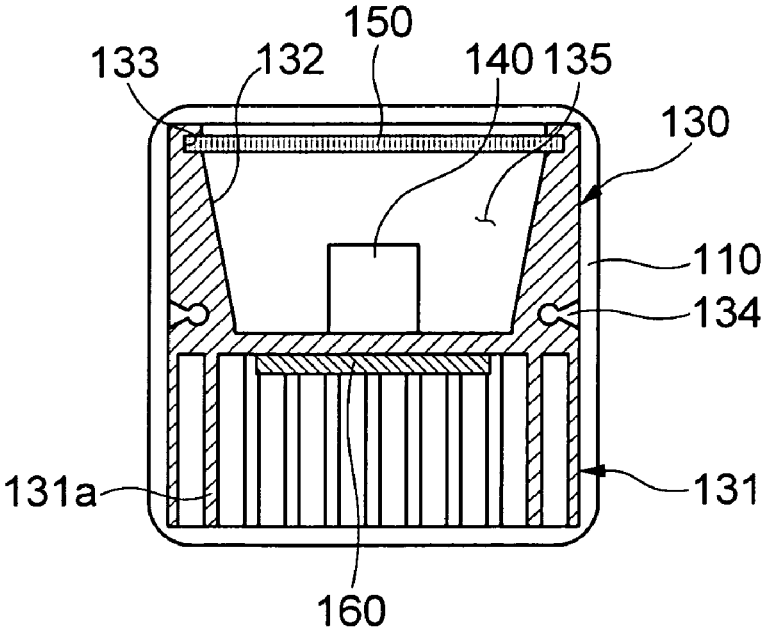
FIG. 4 is a cross-sectional view of the LED light source according to the invention.

FIG. 2 is an exploded perspective view of an LED light source according to the invention. FIG. 3 is an assembled perspective view of the LED light source according to the invention. FIG. 4 is a cross-sectional view of the LED light source according to the invention.

Figure 5:
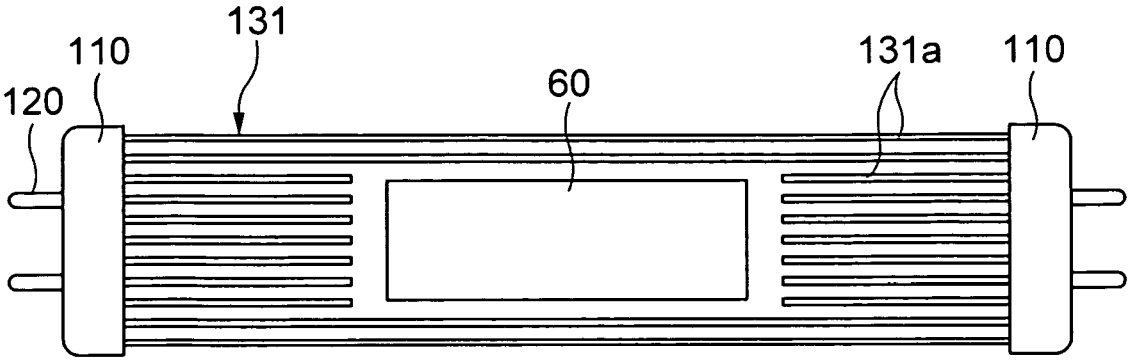
FIG. 5 is a bottom view of the LED light source according to the invention.

FIG. 5 is a bottom view of the LED light source according to the invention.

As shown in FIG. 2, the LED light source includes a pair of plugs 110, a frame 130, a plurality of LEDs 140, a diffuser plate 150, and a power converter 160.

Each of the plugs 10 has one surface coupled to an end of the frame 130 and has more than two terminals 120 projecting from the other surface thereof. The terminals 120 projecting from the other surface of the plug 110 are connected to an external outlet or power supply such as a transformer so as to receive AC power supplied therefrom.

Both ends of the frame 30 are coupled to the plugs 110 having the terminals 120 projecting on the other surface thereof, respectively. Further, the frame 30 has a V-shaped groove 135 formed in the upper portion thereof, and a predetermined circuit (not shown) is printed on the bottom surface of the V-shaped groove 135.

Further, as shown in FIG. 4, the frame 130 has a heat sink 131 formed on the lower surface thereof, the heat sink 131 serving to radiate heat generated when the LEDs 140 emit light. The heat sink 131 is composed of a plurality of heat sink pieces 131*a* formed at even intervals in the lower direction of the frame 130. The plurality of heat sink pieces 131*a* widen a contact area with the air such that the heat generated from the LEDs 140 can be quickly radiated.

Meanwhile, the heat sink 131 composed of the plurality of heat sink pieces 131*a* may be formed integrally with or separately from the frame 130. When the heat sink 131 is formed integrally with the frame 130, an adhesive used for the coupling is not necessary, and the heat radiating property thereof is enhanced.

The frame 130 may be formed of metal such as copper or aluminum with a high heat radiating property. When precision is required so as not to be affected by thermal deformation, the frame 130 may be formed of ceramic such as alumina or alumina nitride. When precision is not required or a manufacturing cost needs to be reduced by slightly decreasing a heat radiating property, the frame 130 may be formed of plastic with excellent heat conductivity.

The frame 130 has an outer groove 134 formed on either outer side surface thereof in the direction where the V-shaped groove is formed. The outer groove 134 widens a contact area with the air so as to radiate the heat generated by the LEDs 140 as quickly as possible. Since the outer groove 134 is formed by removing a portion of the side surface of the frame 130, the manufacturing cost can be reduced.

Both side surfaces of the V-shaped groove 135 of the frame 130 are inclined at a predetermined angle such that the width between the side surfaces decreases toward the bottom surface. Each of the inclined surfaces serves as a reflecting surface 132 for reflecting light emitted from the LEDs 140.

The reflecting surface 132 of the frame 130 reflects light emitted from the LEDs 140 such that the light is not lost into the side surface or rear surface. Then, the light is directed to the front surface, which makes it possible to enhance light efficiency.

The frame 130 has a diffuser-plate fixing groove 133 formed in the upper end thereof, that is, the upper end of the V-shaped groove 135, the diffuser-plate fixing groove 133 having a width corresponding to the thickness of the diffuser plate 150. The diffuser plate 150 is fixed and coupled to the diffuser-plate fixing groove 133.

The LED light source constructed in such a manner can quickly cool down the heat generated from the LEDs 140 by using the heat sink 131 formed in the frame 130. Therefore, it is possible to prevent a reduction in lifespan of the LEDs 140, which is caused by the heat. Further, surrounding equipments are prevented from being degraded by the heat.

Further, the light emitted from the LEDs 140 is reflected by the V-shaped groove 135 so as not to be absorbed or lost into the side or rear surface. Therefore, the light efficiency can be enhanced.

The plurality of LEDs 140 are disposed in line on the bottom surface of the V-shaped groove 135 of the frame 130 and are connected to the circuit printed on the bottom surface of the V-shaped groove 135. The LEDs 140 receives power applied through the circuit so as to emit light.

The diffuser plate 150 is coupled to the upper end of the frame 130 so as to diffuse the light emitted from the LEDs 140. The diffuser plate 150 may be formed of any one selected from a transparent plate for transmitting the light emitted from the LEDs 140 and a fluorescent plate containing a fluorescent material for representing the color of the light emitted from the LEDs 140.

The plurality of LEDs 140 may be combined in various manners. That is, one or more LEDs selected from a white LED, a blue LED, an ultraviolet (UV) LED, an RGB LED, and a single-color LED may be combined. Depending on the selected LED 140, any one of the transparent plate and the fluorescent plate can be selected as the diffuser plate 150, thereby representing various effects desired by a user.

For example, when the white LED is selected as the LED 140, and if the transparent plate is selected as the diffuser plate 150, the LED light source has a correlated color temperature (CCT) of 2000-8000K (absolute temperature) due to the white LED and the transparent plate. Then, it is possible to obtain light efficiency which is the same as or more excellent than that of a general fluorescent lamp (4500-6500K). Therefore, the LED light source can be used as white illumination.

When the blue LED is selected as the LED 140, the fluorescent plate is selected as the diffuser plate 150. Then, the LED light source has the same CCT of 2000-8000K as that of the combination of the white LED and the transparent plate. Therefore, the LED light source can be used as white illumination.

When the UV LED is selected as the LED 140, the fluorescent plate is selected as the diffuser plate 150. When the RGB LED or single-color LED is selected as the LED 140, the transparent plate is selected as the diffuser plate 150.

Then, the LED light source has a CCT of 2000-8000K and can be used as white illumination.

Meanwhile, when the RGB LED is selected as the LED 140, R (red), G (green), and B (blue) LEDs which respectively represent their own colors can be controlled to be simultaneously or separately driven. When they are simultaneously driven, the LED light source may be used as white illumination. Alternately, when they are separately driven, the LED light source may emit only the respective colors of light or various colors of light desired by a user, as the tone of the colors is separately adjusted.

When only red light is desired to be emitted, power is supplied to only the R LED of the RGB LED. When only blue light is desired to be emitted, power is supplied to only the B LED of the RGB LED.

Further, as power is supplied to R and B LEDs, respectively, purple light can be emitted. As an amount of current supplied to each of the R, G, and B LEDs is adjusted, a color and brightness desired by a user can be represented.

The power converter 160 is coupled to the lower portion of the frame 130 and is connected to the plugs 110 and the printed circuit of the frame 130. In this case, the heat sink 131 is not formed on the lower portion of the frame 130 coupled to the power converter 160, as shown in FIG. 5, but the power converter 160 is directly coupled to the lower portion of the frame 130 so as to be connected to the printed circuit formed on the bottom surface of the V-shaped groove 135 of the frame 130.

The power converter 160 receives AC power applied from outside through the terminals 120 of the plug 110 and converts the AC power into DC power for driving the LEDs 140 to supply to the LEDs 140. In this case, it is possible to solve the problem of the conventional LED light source which should be additionally provided with a separate large-volume power converter for driving the LEDs. Further, the LED light source can be reduced in size. Therefore, as only a commercial voltage of 110V or 220V is supplied, the LED light source can be utilized anywhere.

According to the LED light source of the present invention, the LED light source has the power converter provided on the lower portion thereof. Therefore, the LED light source directly receives AC power from outside to convert into DC power, and then supplies the DC power to the LEDs. Accordingly, the LED light source can be effectively utilized.

Further, the heat sink for radiating the heat generated from the LEDs is formed integrally with the frame, thereby enhancing the thermal efficiency. Therefore, it is possible to prevent the reduction in lifespan of the LEDs and the degradation of surrounding equipments.

Furthermore, the LEDs selected from a white LED, a blue LED, an ultraviolet (UV) LED, an RGB LED, and a single-color LED may be used. Therefore, the LED light source can emit various colors of light desired by a user.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A light emitting diode (LED) light source comprising:

a frame having a V-shaped groove formed in the upper portion thereof and a heat sink formed to extend from the lower portion thereof, the V-shaped groove having a planar bottom surface on which a circuit pattern is formed;

a plurality of LEDs disposed on the bottom surface of the V-shaped groove;

a diffuser plate coupled to the upper end of the frame so as to diffuse light emitted from the plurality of LEDs;

a pair of plugs coupled to both side ends of the frame and receiving alternating-current (AC) power from outside; and a power converter fixed and coupled to the lower portion of the frame and electrically connected to the plugs and the plurality of LEDs, the power converter converting the AC power applied from the plugs into direct-current (DC) power and supplying the DC power to the LEDs, wherein the V-shaped groove of the frame has inclined two side walls, formed of reflecting surfaces, between which width decreases in a direction to the bottom surface, wherein the frame is formed integrally with or separately from the heat sink, and wherein the heat sink of the frame has a plurality of heat sink pieces formed at even intervals, and the heat sink is not formed on the lower portion of the frame to which the power converter is coupled.

2. The LED light source according to claim 1, wherein the diffuser plate is any one selected from a transparent plate or a fluorescent plate containing a fluorescent material.

3. The LED light source according to claim 1, wherein the LEDs are one or more LED selected from a white LED, a blue LED, an ultraviolet (UV) LED, an RGB LED, and a single-color LED.

4. The LED light source according to claim 3, wherein when the LED is the white LED, a transparent plate is used as the diffuser plate.

5. The LED light source according to claim 3, wherein when the LED is the blue LED or the UV LED, a fluorescent plate is used as the diffuser plate.

6. The LED light source according to claim 3, wherein when the LED is the RGB LED or the single-color LED, a transparent plate is used as the diffuser plate.

7. The LED light source according to claim 3, wherein the LEDs are simultaneously driven.

8. The LED light source according to claim 6, wherein the R, G, and B LEDs of the RGB LED are separately driven.

9. A light emitting diode (LED) light source comprising:

a frame having a V-shaped groove formed in the upper portion thereof and a heat sink formed to extend from the lower portion thereof, the V-shaped groove having a planar bottom surface on which a circuit pattern is formed;

a plurality of LEDs disposed on the bottom surface of the V-shaped groove;

a diffuser plate coupled to the upper end of the frame so as to diffuse light emitted from the plurality of LEDs;

a pair of plugs coupled to both side ends of the frame and receiving alternating-current (AC) power from outside; and a power converter fixed and coupled to the lower portion of the frame and electrically connected to the plugs and the plurality of LEDs, the power converter converting the AC power applied from the plugs into direct-current (DC) power and supplying the DC power to the LEDs, wherein the V-shaped groove of the frame has inclined two side walls, formed of reflecting surfaces, between which width decreases in a direction to the bottom surface.

* * * * *